US006105955A

United States Patent [19]

Rawlings et al.

[11] Patent Number: 6,105,955

[45] Date of Patent: Aug. 22, 2000

[54] FEEDER STRUCTURE AND RECEIVING WHEEL FOR HIGH SPEED INSERTER

[75] Inventors: Greg A. Rawlings, Madison; William R. Kline, Osage City; Donald A. Glaser, Emporia; David D. Rhoads, Neosho Rapids, all of Kans.

[73] Assignee: Kansa Corporation, Emporis, Kans.

[21] Appl. No.: 09/069,258

[22] Filed: Apr. 29, 1998

[51] Int. Cl.[7] ..... B65H 5/08

[52] U.S. Cl. ..... 271/11; 198/457.02; 198/457.03; 198/457.06; 198/479.1; 198/624; 198/722; 198/457.07; 198/462.2

[58] Field of Search ..... 198/457.02, 457.03, 198/457.06, 479.1, 624, 722, 462.2, 457.07

[56] References Cited

U.S. PATENT DOCUMENTS

| | | | |
|---|---|---|---|
| 2,580,469 | 1/1952 | Schwartz | 198/624 |
| 4,058,151 | 11/1977 | Yonezu | 144/246 |
| 4,155,842 | 5/1979 | Wallace et al. | 198/722 X |
| 4,273,235 | 6/1981 | Rustand | 198/624 X |
| 4,526,356 | 7/1985 | Swint | 270/55 |
| 4,925,004 | 5/1990 | Menge | 198/457.02 |
| 4,997,334 | 3/1991 | Shimura | 198/624 X |
| 5,125,637 | 6/1992 | Glaser | 271/11 |
| 5,620,082 | 4/1997 | Saito | 198/624 |
| 5,816,773 | 10/1998 | Fehringer et al. | 414/789.9 |

*Primary Examiner*—Christopher P. Ellis
*Assistant Examiner*—Richard Ridley
*Attorney, Agent, or Firm*—Hovey, Williams, Timmons & Collins

[57] ABSTRACT

A multiple station in-line product handling machine (40) is provided which has infeed stations (42–46) equipped with improved feeder and receiving units (60, 62) as well as a unique pusher chain assembly (78). The feeder units (60) include a sucker shaft (88) adapted to successively grip the leading ends (336) of the bottom products (334) in a stack thereof and to pivot such leading ends (336) downwardly without any substantial translational movement of the product (334); the downwardly pivoted ends (336) are then engaged by a cooperating nip roller (100) and feed belt assembly (71) to withdraw the product (334) from the stack. Preferably, the sucker shaft (88) and nip roller (100) are driven by respective cams (106, 108) mounted on a powered shaft (110). The receiving units (62) have receiving structure (74) together with a rotatable wheel (76) equipped with a resilient peripheral product-engaging element (174) which quickly and reliably move the fed product (334) along the length of the machine (10). Preferably, a pusher pin (82) forming a part of chain assembly (78) is moved in timed relationship with wheel (76) so that the element (174) and pin (82) substantially simultaneously engage the product (334) to move it from the receiving unit (62). The chain assembly (78) is made up of a whole number of end-to-end interconnected chain sections (296) each having a plurality of strategically located pin mounts (81) so that changeover of the assembly (78) to handle products of different lengths can be readily accomplished.

3 Claims, 14 Drawing Sheets

FEEDER STRUCTURE AND RECEIVING WHEEL FOR HIGH SPEED INSERTER

BACKGROUND OF THE INVENTION

1. Field of the Invention

The present invention is broadly concerned with improvements in elongated, multiple-station, in-line product handling equipment of the type used to handle and insert supplements into newspapers or similar products in order to significantly increase the operating speed and reliability of such machines. More particularly, the invention pertains to such equipment wherein an improved, high-speed inserter is provided having a feeder unit for individual feeding of newspaper or like products from a stack thereof together with a receiver unit for receipt of the individually fed products and rapid conveying thereof along the length of the machine. The feeder unit includes a pivotal sucker bar operable for initially gripping the leading end of the lowermost product of a stack and pivoting the end downwardly without any substantial translation of the gripped product; a lightweight translatable and rotatable nip roller then engages the downwardly pivoted product end and, in conjunction with a feeder belt, delivers the product from the stack. The receiving unit has a rotatable feeder wheel equipped with a resilient periphery which engages the fed product and moves it along the length of the machine; the operation of the wheel is correlated with that of a pusher chain unit so that a pusher pin engages the trailing edge of the product substantially simultaneously with the wheel so as to rapidly and positively move the product from the receiver unit. An improved pusher chain assembly is also provided which is made up of a whole number of interconnected chain sections each having a plurality of pin mounts secured thereto which are strategically placed so that the chain assembly can be rapidly modified for handling products of different lengths.

2. Description of the Prior Art

Newspaper sections and advertising tabloids, generally consist of a plurality of flat, identically-sized sheets of paper, wherein the sheets are folded within the next contiguous sheet such that a common centerfold is produced. However, often additional pages, flyers or other materials must be inserted within the section subsequent to the original assembly of the section. In some cases, not all of the sheets intended to be placed within the section are printed at the same time. In other cases, advertising flyers and smaller inserts are printed at a different location and must be placed within the section as soon as the latter is printed. In the past, these inserts have typically been stuffed into a newspaper section by hand. However, this operation is troublesome, labor intensive and time-consuming, causing the price of the final product to increase accordingly.

In recent years, a number of multiple station, in-line machines have been developed for the mechanized handling and inserting of supplements into newspapers and like products. For example, U.S. Pat. No. 4,526,356 discloses a specific insert mechanism useful in this context. Additionally, U.S. Pat. No. 5,125,637 discloses a feeder arrangement for such machines.

While machines of this type represent a decided advancement in the art, there is still a need for improved performance, particularly in the areas of throughput (i.e., number of products handled per hour), reliability and makeready times. For example, existing machines are sometimes plagued by the phenomenon known as "bagging." That is, typical feeders are provided with a sucker bar unit which is oriented to initially grip the lowermost edge of the bottom product of a stack and pivot this edge downwardly to a location where it can be engaged by a nip roller for feeding thereof. However, during this initial pivoting operation there is a tendency to also pull and translate the bottom product relative to the stack. This in turn causes the next adjacent product to buckle or "bag." If this occurs, the next time the sucker bar unit moves upwardly to engage the product, it cannot effectively grip it owing to the presence of the bagged portion. In severe cases, this condition will cause the sucker bar unit to grip the next adjacent product, rather than the bottom most product of the stack, and pull both of them downwardly towards the nip roller. This creates a very significant misfeed or jam, requiring operator intervention and consequent processing slowdown.

Conventional receiving units also have presented problems, principally because of the inability to quickly and cleanly receive the fed products and move them in a transverse direction relative to the feeding direction. Specifically, the feeder unit in such machines delivers the products along a first path of travel to the receiving unit, whereupon the latter must reliably initiate movement of the product in a direction transverse to the first path of travel, at high speeds.

Finally, changeover and makeready time with prior machines has been significant, principally owing to the need to reconfigure the pusher chain assemblies thereof. In particular, these machines have an elongated, continuous chain which supports a plurality of spaced apart pusher pins which are adapted to engage the trailing edges of received products in order to move them along the lengths of the machines. When it is necessary to change over a given machine to handle differently sized products, it can be a time-consuming process to reset the pusher pins along the length of the chain for most efficient handling. Similarly, the makeready for the remaining components of the machine can also be a lengthy process.

SUMMARY OF THE INVENTION

The present invention overcomes the problems outlined above, and provides an improved product handling machine equipped with a plurality of infeed stations each having a product feeder for individually feeding elongated products such as newspapers or the like from a stack thereof together with receiving units for receiving the fed products and quickly and reliably moving the products in a direction transverse to the feeding direction along the length of the machine. In addition, the preferred machine has a pin conveyor assembly including a continuous chain supporting a plurality of spaced apart product-engaging pins each adapted to engage the trailing edge of a respective fed product for moving the latter along the length of the machine. The pin conveyor assembly is made up of a whole number of individual chain sections interconnected end-to-end with a plurality of strategically located pin mounts facilitating rapid changeover of the machine to handle differently sized products.

In more detail, the product feeders of the invention include a product holding table presenting a front margin and adapted to hold a product stack with the leading ends of the products projecting forwardly beyond the table front margin. A shiftable sucker unit is located adjacent the table and has a product-engaging sucker. A shifter is coupled with the sucker unit in order to move the latter between a gripping position where the sucker is in gripping engagement with the leading end of the lowermost product of the stack, and a delivery position wherein the product leading end is pivoted downwardly about the table front margin without any substantial translatory movement of the product relative to the remaining products in the stack. A product removing assembly is also provided for engaging the leading end of the downwardly pivoted product in order to positively move the lowermost product from the table.

Advantageously, the sucker unit has a pivotal sucker shaft mounted for pivoting movement about an axes closely adjacent the front margin of the table. The sucker shaft also carries an elongated finger adapted to engage the underside of the lowermost product during downward pivoting thereof in order to create an uplifted or tented region in the product; this has been found to somewhat rigidify the product and facilitate its feeding.

The product removing assembly preferably includes a translatable and rotatable hollow nip roller together with a cooperating underlying belt assembly for gripping and shifting the initially downwardly pivoted products. The drive for the sucker shaft and nip roller is preferably in the form of a pair of cams with first and second motion-transmitting links between the respective cams and the sucker shaft and nip roller respectively.

The receiving units of the infeed stations include receiving structure configured to receive products as they are fed by the feeder unit along with a product moving assembly including a powered driving wheel presenting a resilient, peripheral product-engaging element and an adjacent rotatable anvil. The driving wheel and anvil are spaced apart a distance for cooperatively engaging and moving the fed products along the length of the machine transverse to the feeding direction. Preferably, the resilient element is formed of hollow rubber-like material and extends partially around the periphery of the driving wheel, and the anvil is an idler disposed below the driving wheel.

In preferred practice, the driving wheel and pin conveyor assembly of the machine are operated in a timed relationship so that the resilient wheel element contacts a fed product and a pusher pin of the conveyor assembly substantially simultaneously engages the trailing edge of the product. Thus, the product is rapidly and cleanly shifted from the receiving unit by the combined actions of the driving wheel and pin conveyor.

The pin conveyor assembly is made up of a whole number of individual, essentially identical chain sections interconnected end-to-end to form a continuous chain. Each of the chain sections has a plurality of pin mounts with the latter being arranged in a plurality of pin mount sets along the length of the chain sections. Each of the pin mount sets has a number of pin mounts evenly spaced along the length of the section beginning at the first link thereof and terminating at the last link thereof, with the distance between adjacent pin mounts in each pin mount set being different than the spacing between adjacent pins in the other pin mount sets. By way of example, a preferred chain is made up of a whole number of individual chain sections each having a length of90", with three pin mount sets provided on each chain section. One of the pin mount sets has a distance between pin mounts of 15", another of the pin mount sets has a distance between the pin mounts of 18", and the final pin mount set has a distance between the pin mounts thereof of 22.5".

DETAILED DESCRIPTION OF THE PREFERRED EMBODIMENT

Figure 1:
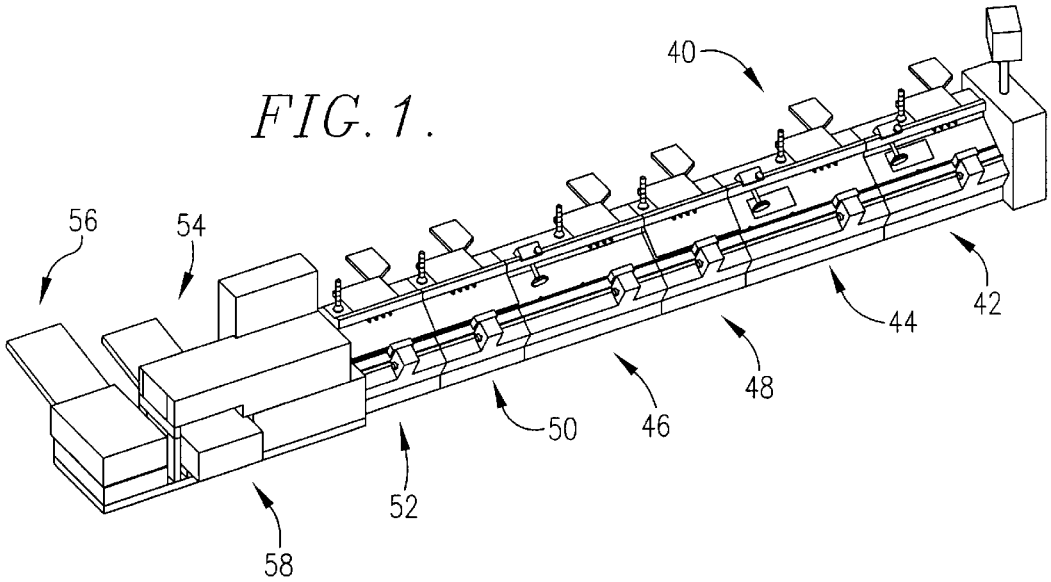
FIG. 1 is a perspective view illustrating a multiple station, in-line product handling machine in accordance with the invention.

Turning now to the drawings, and particularly FIG. 1, an exemplary elongated, in-line, multiple station handling machine 40 is illustrated which may be used for the processing of discrete articles such as newspapers. The machine 40 includes three main product infeed stations 42, 44 and 46, three secondary infeed set stations 48, 50 and 52, a dual-gate, unacceptable product diverter assembly 54, acceptable product outfeed conveyor 56 and an unacceptable diverted product conveyor 58.

It is to be understood that the machine 40 depicted in FIG. 1 is illustrative only, in that in practice a given handling machine may have a number of additional or different functional stations. In any case, the machine 40 is designed to receive individual discrete articles such as newspapers and to process such products by, e.g., insertion of additional sections or inserts, and to deliver acceptable products to the conveyor 56, all at high speeds.

The present invention is primarily directed to specific improvements in the infeed stations 42–52, and the product conveying mechanism associated with the overall machine, in order to permit the infeed stations to more rapidly feed product into the machine proper while eliminating misfeeds and jams, while the conveying mechanism smoothly and evenly moves the product through the machine for final handling.

Broadly speaking, the improved infeed stations of the invention include a feeder assembly 60 (FIGS. 5–10), a product direction diversion area having receiving assembly 62, and a station drive assembly 64. The feeder assembly 60 in turn has a product table 66, sucker bar unit 68, nip roller unit 70, feeder belt assembly 71, and a double cam drive 72 for the sucker bar unit 68 and nip roll unit 70. The receiving assembly 62 includes a receiver structure 74 as well as a rotatable receiving and product driving wheel unit 76. The conveying mechanism includes a continuous pusher pin chain assembly 78 including a feeder unit in the nature of a continuous pin-supporting roller chain 80 having a plurality of spaced apart, threaded stud pins mounts 81 each supporting an obliquely oriented pusher pin 82.

Figure 6:
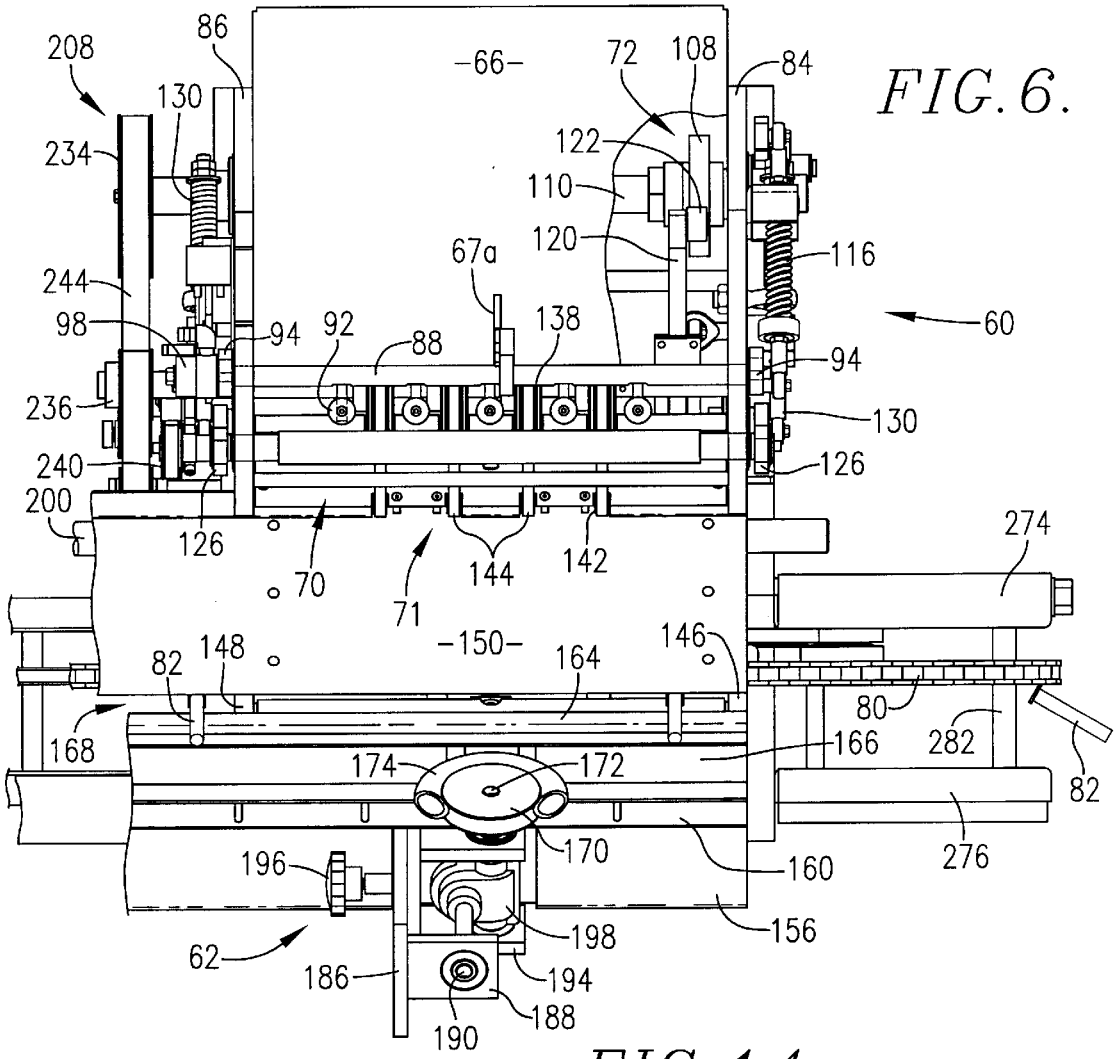
FIG. 6 is a fragmentary top view with parts broken away and further illustrating the station shown in FIG. 5.

The overall feeder assembly 60 includes a pair of laterally spaced apart side frames 84, 86 which support the substantially planar, horizontally disposed product table 66, the latter including conventional, laterally shiftable upright product stack guides 67 and centrally disposed, forwardmost slot 67*a* as best seen in FIG. 6. In addition, the sucker bar unit 68, nip roll unit 70 and double cam drive 72 are supported by the side frames 84, 86.

Figure 13:
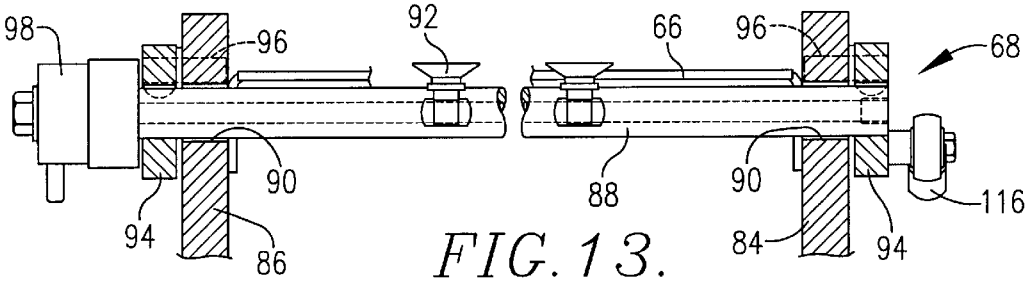
FIG. 13 is a fragmentary vertical sectional view illustrating the sucker bar and product table of the feeder assembly of the product infeed station.
Figure 15:
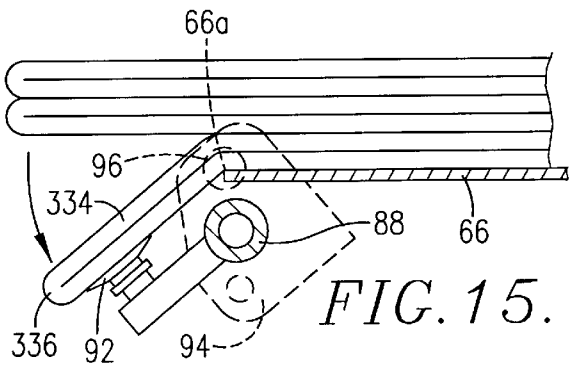
FIG. 15 is an enlarged, sectional schematic view illustrating the sucker bar assembly during initial removal of product from the product table of the infeed station.

In detail, the sucker bar unit 68 includes an elongated tubular sucker shaft 88 which extends laterally between the side frames 84, 86 and is received within openings 90 (FIG. 13) provided in each side frame so as to permit pivoting movement of the sucker shaft 88. The sucker shaft supports five spaced apart vacuum-operated cup-type suckers 92 along the length thereof between side frames 84, 86. It will be appreciated that the suckers are operatively coupled with the bar shaft 88 and are in communication with the internal vacuum passageway provided therein. As best seen in FIG. 13, the shaft 88 extends beyond the respective side frames 84, 86 and each projecting end thereof is secured to a pivot blocks 92 and 94. Each block 94 is in turn pivotally coupled to the adjacent side frame by means of a pivot pin 96. As best seen in FIG. 15, the axes of the aligned pins 96 are substantially coincident with the upper terminal edge 66*a* of product table; the importance of this feature will be made clear hereinafter. The end of shaft 88 adjacent side frame 86 is equipped with a selectively actuatable vacuum valve unit 98 which is coupled to a vacuum pump (not shown). Finally, the shaft 88 supports a central product tenting finger 99 which moves with the sucker bar as will be explained.

The nip roll unit 70 (FIG. 14) includes an elongated, axially rotatable tubular roller 100 which extends between the side frames 84, 86 and has the central region thereof covered with a resilient sleeve 102. In order to allow translational movement of the roller 100, each side frame 84, 86 has an enlarged, generally oval-shaped opening 104 to receive the ends of the roller. It will be noted that the roller 100 is located in close adjacency and somewhat forward of the sucker bar 88 as best illustrated in FIGS. 18–21.

The feeder belt assembly 71 includes an elongated, powered, axially rotatable cross shaft 136 which extends between side frames 84, 86. The shaft 136 supports a total of four laterally spaced apart, relatively large diameter belt wheels 138. In addition, the assembly 71 has an elongated, obliquely oriented support plate 140 which extends downwardly from the upper periphery of the wheels 138 (FIG. 11) and is adjustably supported between the side frames 84, 86. The lower end of plate 140 has attached thereto four rotatable, relatively small diameter idler belt wheels 142 which are respectively in alignment with the wheels 138. Individual feeder belts 144 are trained around the aligned sets of wheels 138, 142 as shown and have their upper runs passing over plate 140. The plate 140 also has a central opening 145 (FIG. 8) and supports an underlying optical sensor 145*a* in registry with the opening 145.

Figure 9:
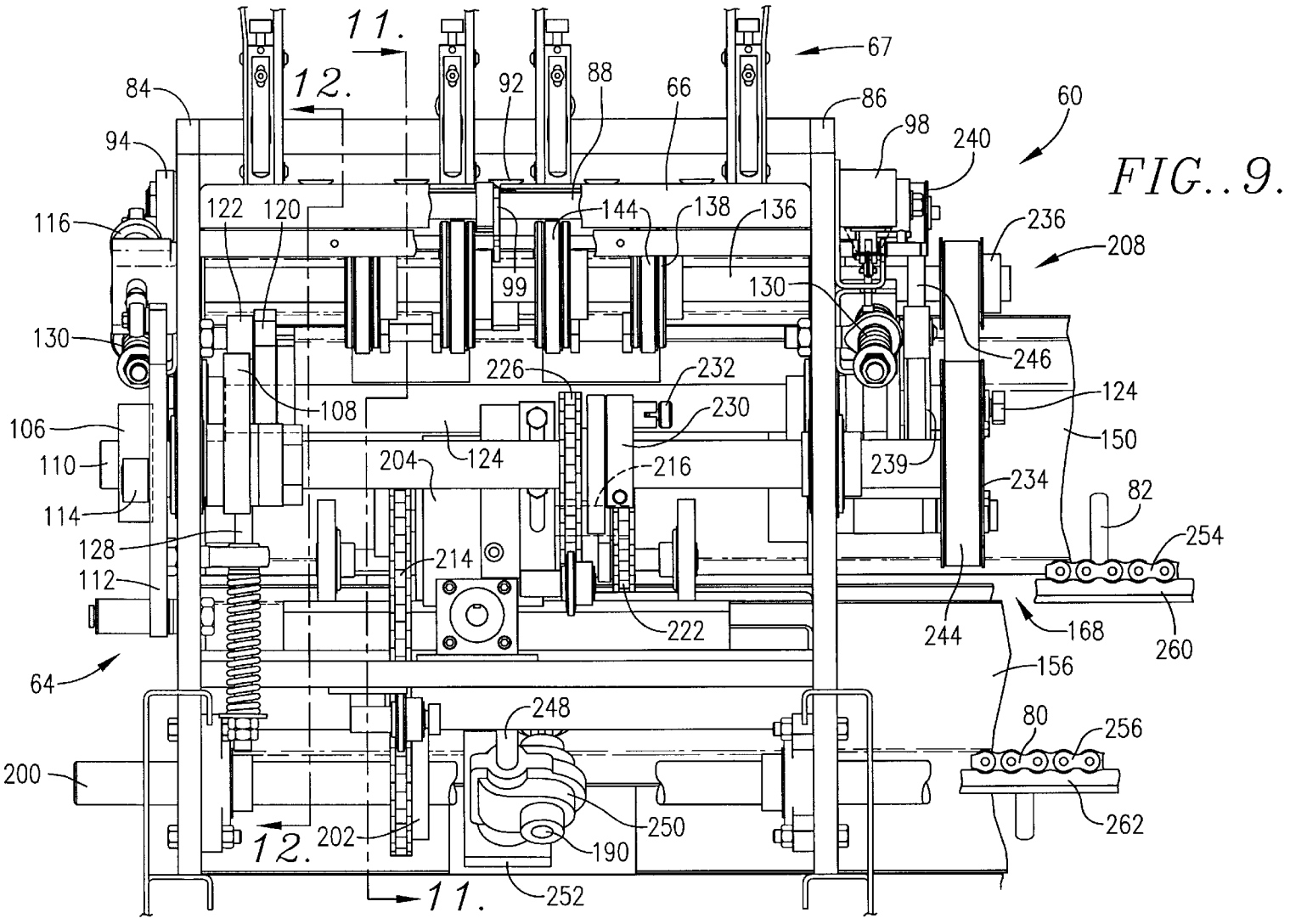
FIG. 9 is a fragmentary rear view of the infeed station illustrated in FIGS. 5–8.

The double cam drive 72 is operatively coupled to the sucker bar unit 68 and nip roll unit 70. The drive 72 includes a pair of specially configured cams 106, 108 respectively disposed on opposite sides of side frame 84. Both such cams are mounted on a common rotatable cross shaft 110 which extends between the side frames 84, 86 as best seen in FIG. 9. The outer cam 106 controls the sucker bar unit 68. For this purpose, an elongated arm 112 is pivotally secured to the outer face of side frame 84 (FIG. 7) and carries an intermediate cam follower 114 engaging cam 106. The upper end of arm 112 has an elongated, spring-loaded link 116 which extends to and is coupled with pivot block 94 and biases the sucker bar unit 68 to its home position.

Figure 14:
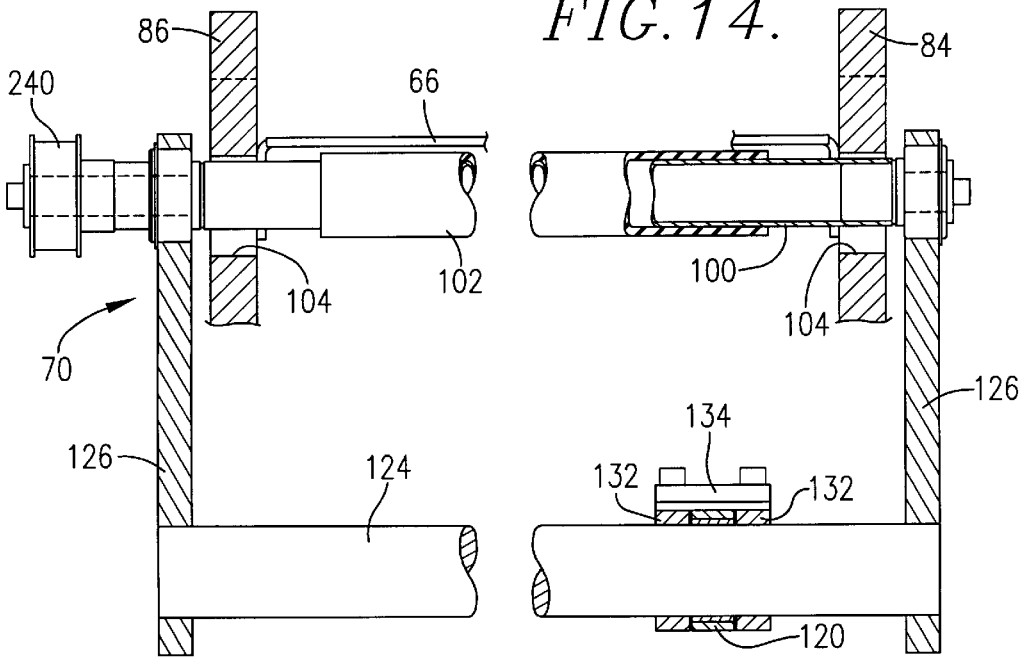
FIG. 14 is a fragmentary vertical sectional view depicting the shiftable nip roller assembly forming a part of the feeder assembly of the product infeed station.
Figure 7:
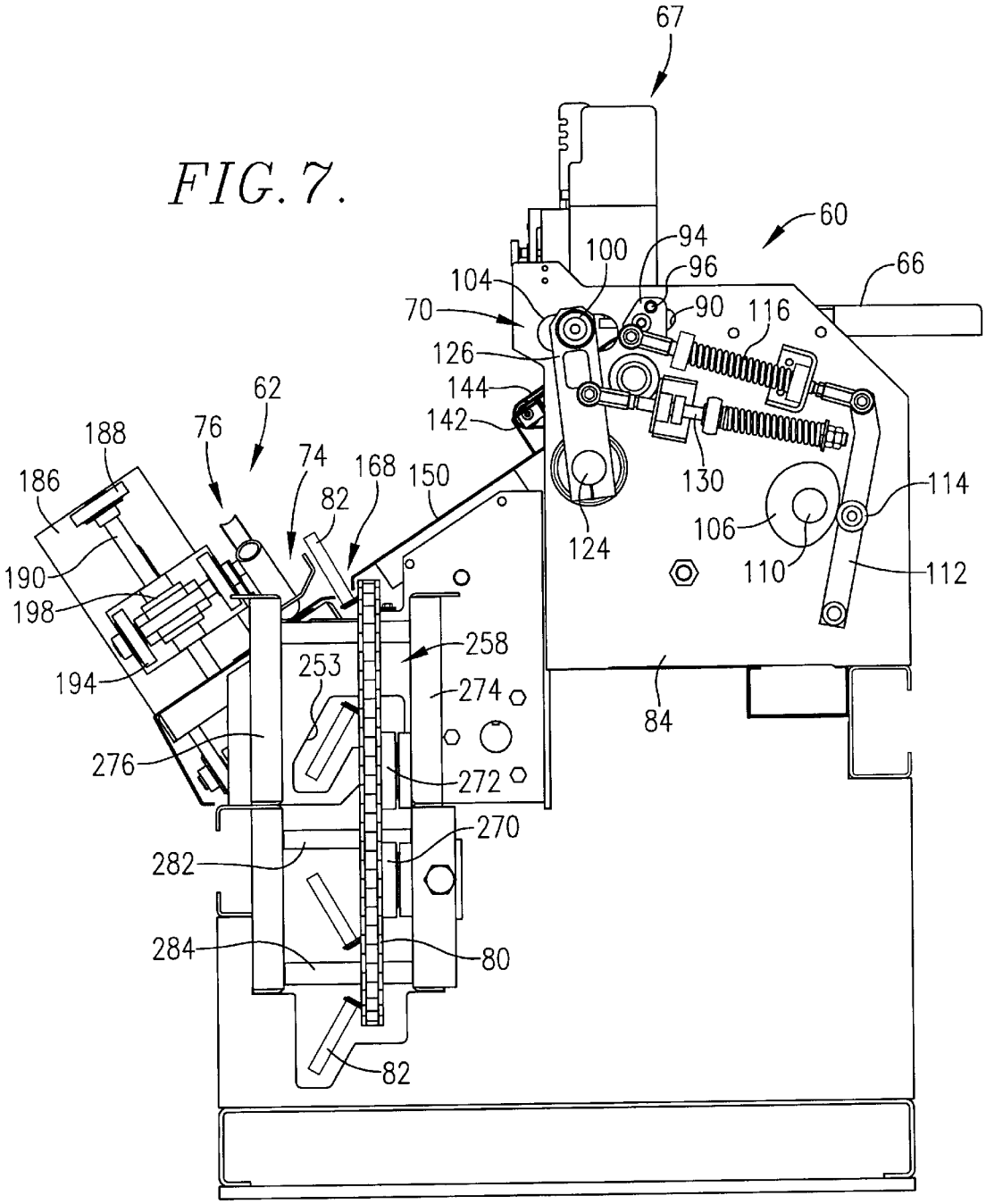
FIG. 7 is an end elevational view of the initial product infeed station shown in FIGS. 5–6.
Figure 12:
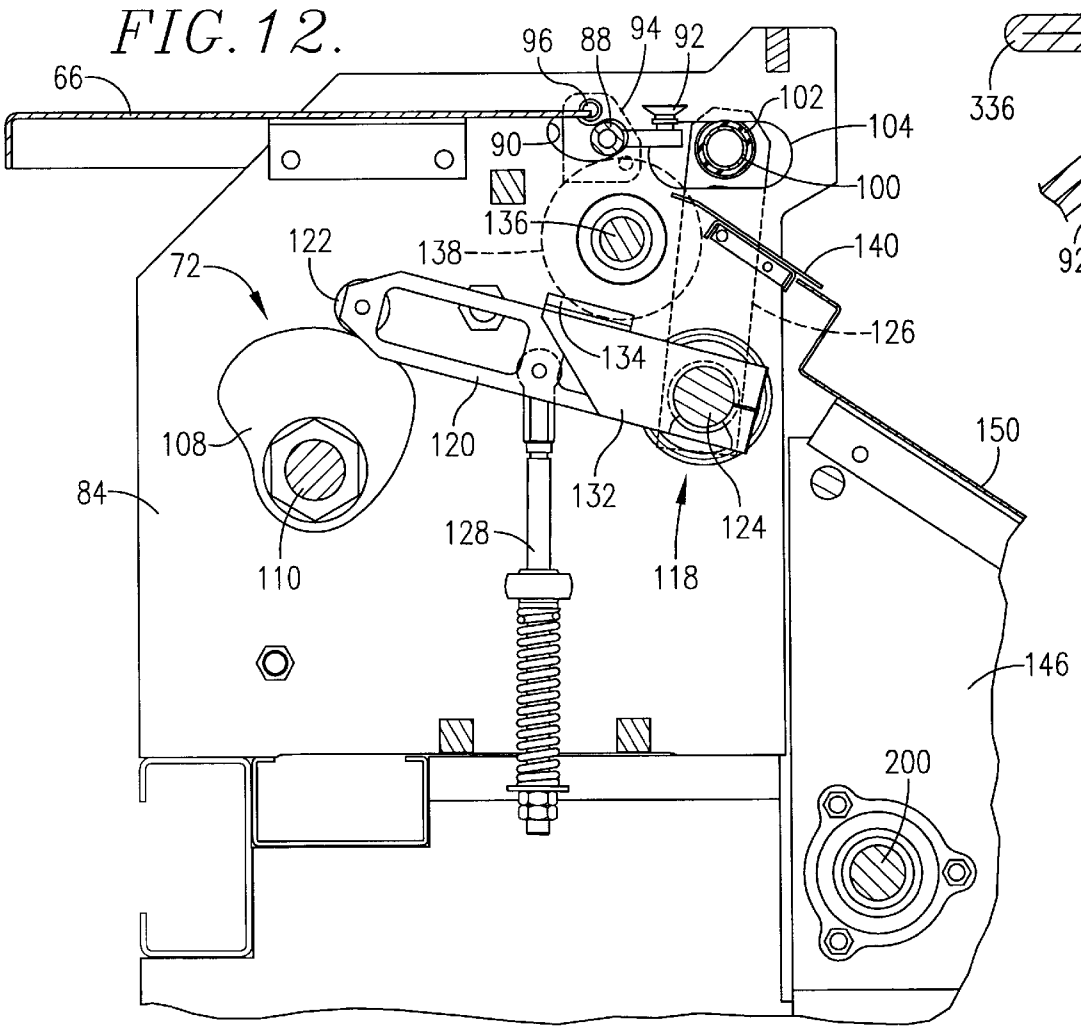
FIG. 12 is a view taken along line 12—12 of FIG. 9 and depicting the inboard cam and follower arrangement forming a part of the product infeed station.

The inner cam 108 controls the translational movement of nip roll unit 70. For this purpose, an internal linkage assembly 118 (FIG. 12) is operatively coupled between the cam 108 and roller 100. The linkage assembly 118 has an elongated first arm 120 which carries a rotatable cam follower 122 engaging cam 108; the arm 120 is journaled about and pivotal relative to a transverse mounting shaft 124. The shaft 124 also supports a pair of upright, fixedly mounted second arms 126 respectively positioned adjacent the outboard face of side frames 84, 86 which are in turn secured to the adjacent ends of roller 100 (FIG. 14). An internal spring biased link 128 is secured to the inner face of side frame 84 and first arm 120 intermediate the ends thereof so as to assure continued contact between follower 122 and cam 108 during rotation of the latter. Similarly, a pair of spring biased links 130 are respectively secured to the outboard faces of side frames 84, 86 and are coupled with the corresponding second arms 126 so as to bias the nip roller unit 70 rightwardly as seen in FIG. 7. Finally, a pair of short third arms 132 (FIG. 14) are fixedly secured to shaft 124 on opposite sides of pivotal first arm 120. A bridge plate 134 spans the arms 132 and is positioned above the upper marginal edge of the arm 120.

Figure 8:
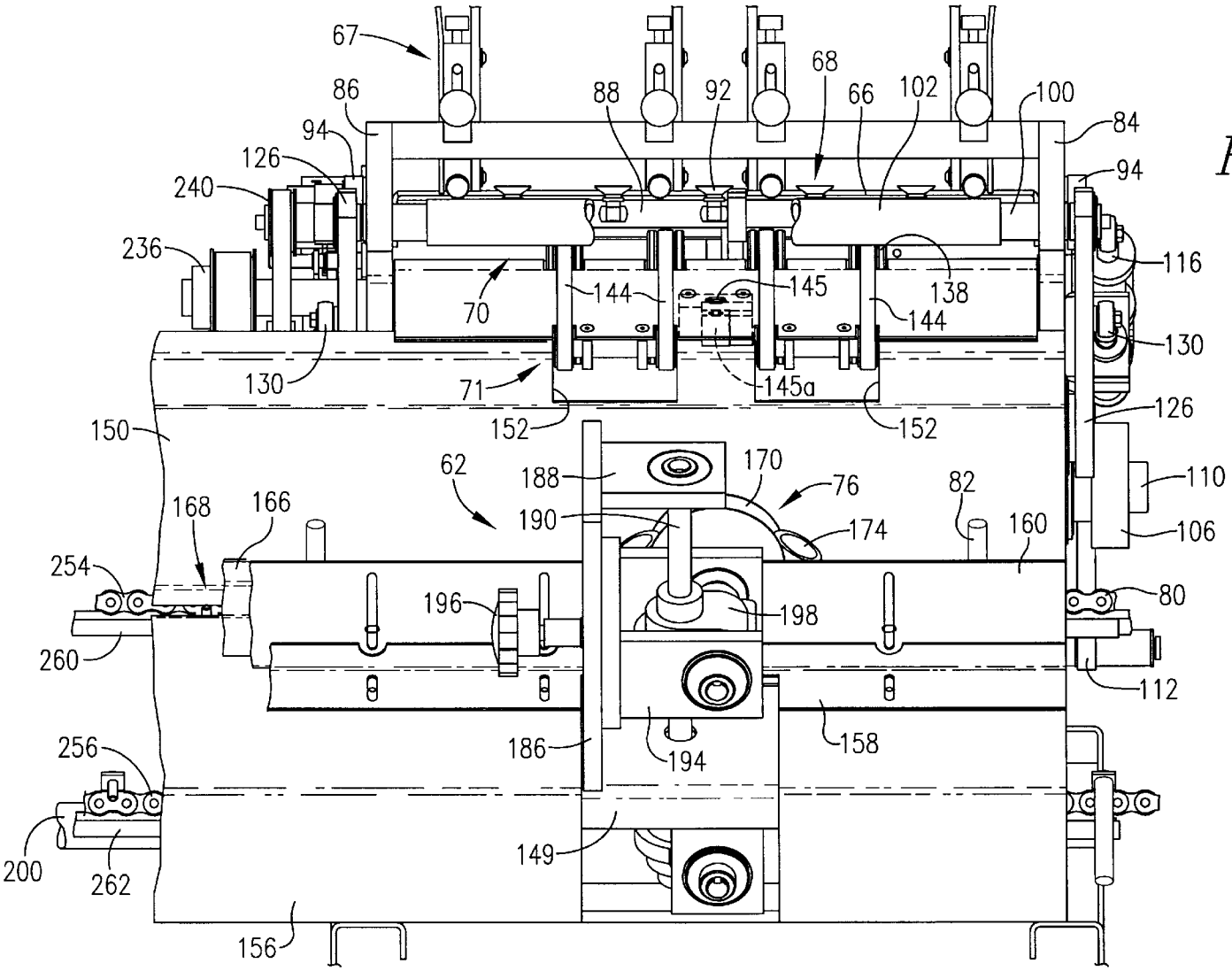
FIG. 8 is an enlarged, fragmentary front view similar to that of FIG. 5 but showing in greater detail the infeed station.

The receiving assembly 62 is located below and laterally offset from feeder assembly 60, and is supported on side frames 146, 148 and a channel 149 extending therebetween. These side frames support the receiving structure 74 as well as the receiving wheel unit 76. In particular, the structure 74 includes an elongated, laterally extending main support plate 150 which is disposed below the feeder belt assembly 71 in an oblique orientation; the plate 150 extends the full length of machine 40 to a leveling transition section 150*a* (FIG. 3) leading to the inlet of diverter 54. As best illustrated in FIG. 8, the upper end of the plate 150 has two notches 152 to accommodate adjacent sets of the feeder belts 144. The structure 74 further includes a lowermost receiver section 154 made up of a lower guard plate 156 which adjustably supports an L-shaped bracket 158. The bracket 158 in turn supports a second, larger L-shaped plate 160 having an upwardly extending lower leg 162. The lower leg 162 supports a lower receiver plate 164. Finally, the L-shaped plate 160 supports an upwardly extending upper receiver plate 166. It will be observed that the plates 164, 166 are spaced apart so as to define a zone therebetween for receiving product, with the upstanding leg of plate 160 defining a product stop. Also, it will be seen that an elongated pin-clearing slot 168 is defined between the adjacent edges of mainplate 158 and lower receiver plate 164.

Figure 10:
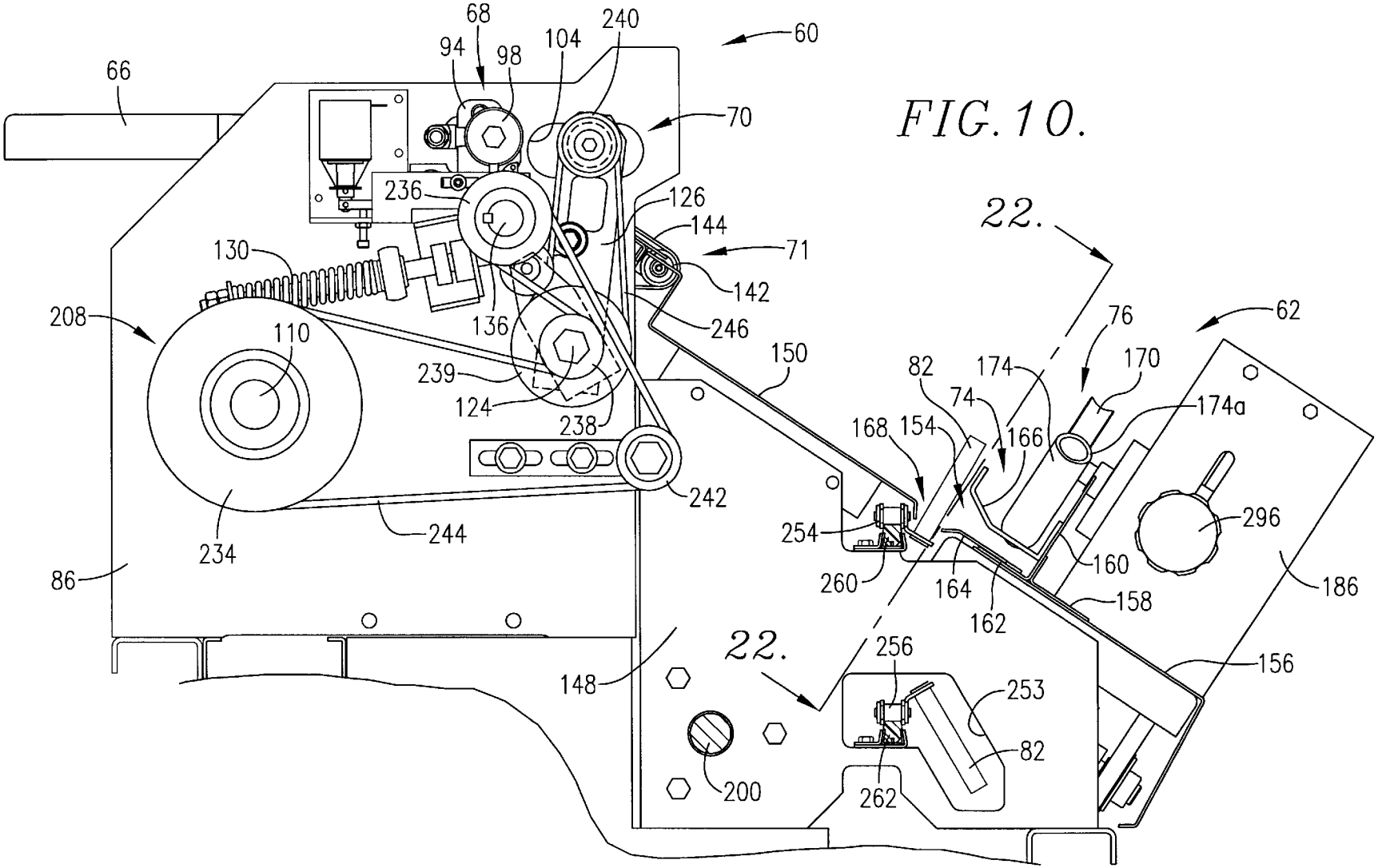
FIG. 10 is an enlarged fragmentary end view of the initial product infeed station, depicting the drive side thereof opposite that shown in FIG. 7.
Figure 22:
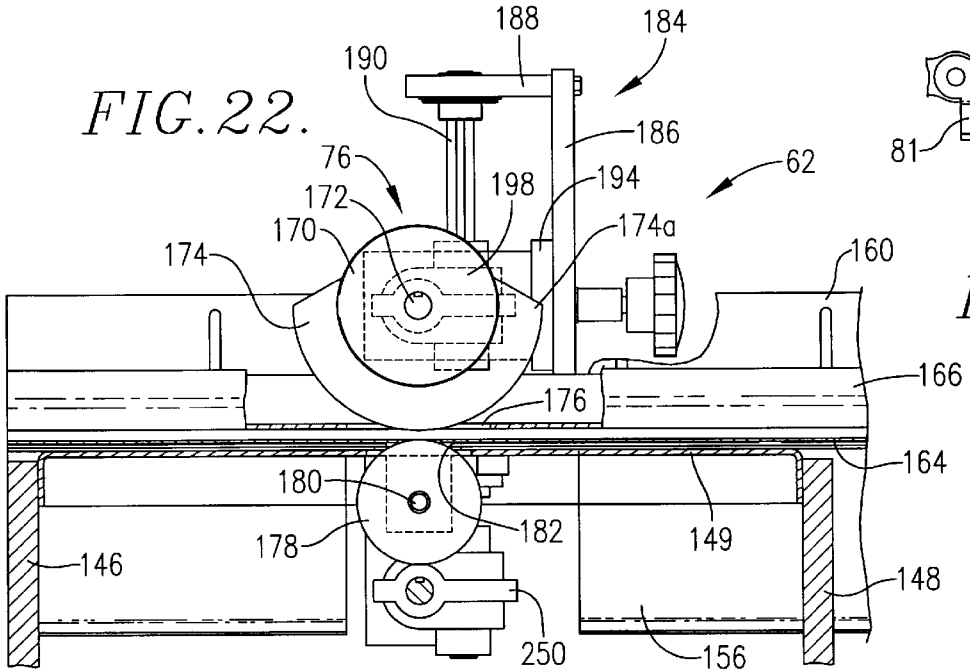
FIG. 22 is a fragmentary, sectional view taken along line 22—22 of FIG. 10 and illustrating in greater detail the product receiving assembly forming a part of the infeed assembly.
Figure 23:
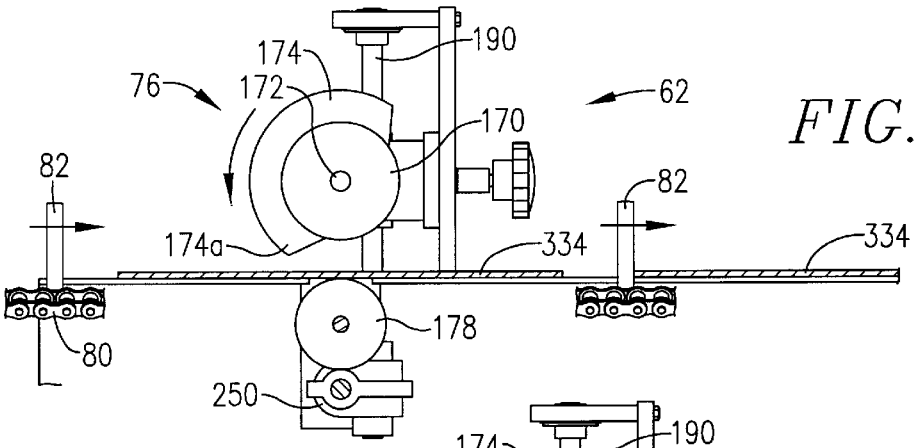
FIG. 23 is a schematic view depicting the receiving assembly with a product therein and prior to pickup of the product by the pusher pin and receiving wheel.

The receiving wheel unit 76 includes a circular drive wheel 170 supported for rotation on a central output shaft 172. The wheel 170 also is equipped with an outermost, resilient, tubular sector-shaped product-engaging element 174. The wheel 170 is mounted above the upper receiver plate 166 as best seen in FIG. 10. In order to permit driving engagement between the elements 174 and product received within the structure 74, the plate 166 has a central opening 176 therein. The overall unit 76 also has a lower idler anvil wheel 178 mounted on shaft 180. As best seen in FIG. 22, the wheel 178 is directly below wheel 170, and in order to permit the wheel 178 to come into contact with product, the plate 164 has an opening 182 therein.

During use of machine 40 when different products are being processed, it may be necessary to adjust the vertical position of upper wheel 170. Accordingly, an adjusting unit 184 is provided for the wheel 170. Specifically, the adjusting unit includes a slotted vertical plate 186 secured to channel 149 as well as a lateral plate 188 affixed to plate 186 adjacent the upper end thereof. An obliquely oriented, axially rotatable, keyed drive shaft 190 is journaled within a bearing carried by plate 188, and is further supported by a lower bearing block 192 affixed to the underside of channel 149. The shaft 190 carries a shiftable, U-shaped mount 194 which has a threaded clamp 196 secured thereto which extends through the slot of plate 186. The mount 194 carries a drive unit which includes a gear box 198 having a output shaft 172. Thus, the clamp 196 may be loosened as required and the mount 194 and gear box 198 can be vertically adjusted along the length of shaft 190, whereupon the clamp is again tightened.

The station drive assembly 64 is coupled to an elongated line shaft 200 which extends the full length of the machine. The assembly 64 broadly includes a main sprocket 202 coupled to line shaft 200, a primary gear box 204, a receiving unit gear box 206 and a belt drive assembly 208.

Figure 11:
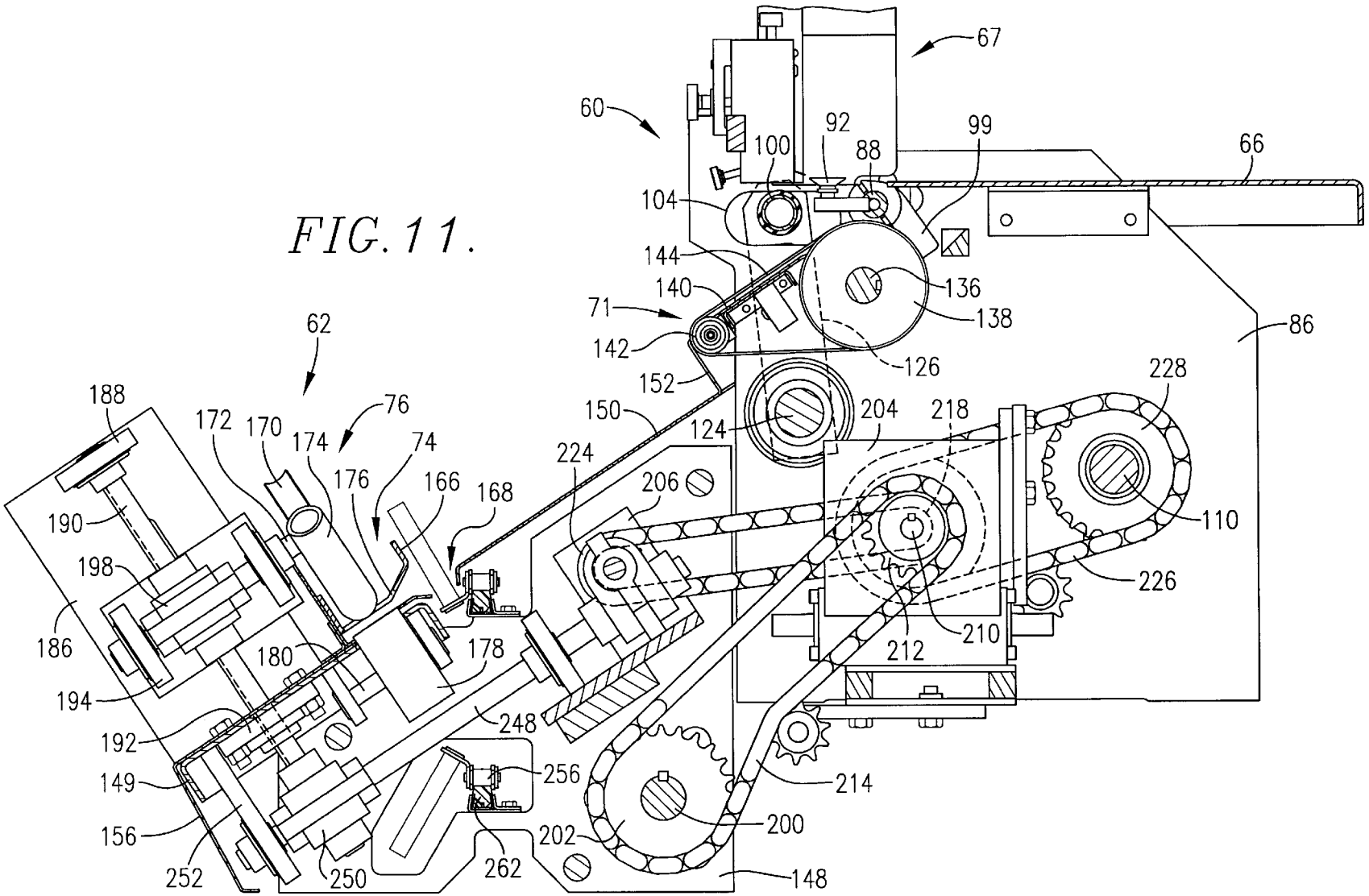
FIG. 11 is a sectional view taken along line 11—11 of FIG. 9 and depicting in detail the drive assembly for the product infeed station.

Referring to FIGS. 9 and 11, it will be seen that the primary gear box 204 has an input shaft 210 and a sprocket 212. A first roller chain 214 is trained around the sprockets 202 and 212 for providing input torque from line shaft 200 to primary gear box 204. The gear box 204 also has an output shaft 216 which supports a pair of spaced sprockets 218, 220 (FIG. 11). An output roller chain 222 extends between output sprocket 218 and an input sprocket 224 forming a part of gear box 206. Another output roller chain 226 is trained about sprocket 220 and a sprocket 228 mounted on the cam-supporting cross-shaft 110. In the latter case, the sprocket 228 is detachably secured to a block 230 fixedly mounted on shaft 110. A spring-loaded coupler 232 is provided for selective connection of the block 230 and sprocket 228. It will thus be appreciated that the line shaft 200 operates through the described chain and sprocket assemblies and primary gear box 204 to rotate cross shaft 110 which serves to rotate the cams 106, 108 controlling the pivoting of sucker shaft 88 and the translation of nip roller 100.

As best seen in FIG. 9, the shaft 110 extends through side frame 86 and supports a large pulley 234 forming a part of belt drive assembly 208. The latter additionally includes a smaller pulley 236 mounted on the outboard end of shaft 136 supporting the large diameter feeder wheels 138, a pair of interconnected pulleys 238, 239 journaled on the end of shaft 124, a pulley 240 mounted on the end of roller 100, and finally an idler pulley 242. A first continuous drive belt 244 is trained around pulleys 234, 238, 236 and 242 in order to rotate the shaft 136; the pulley 238 rotates relative to shaft 124. A second continuous belt 246 is trained around pulleys 239 and 240 in order to rotate the nip roller 100.

The drive assembly for the receiving wheel unit 76 includes the gear box 206 having an elongated, obliquely extending, rotatable output shaft 248 terminating in another gear box 250 supported on plate 252. As best seen in FIG. 11 output shaft 190 extends from the gear box 250 upwardly through bearing block 192 and gear box 198.

Figure 5:
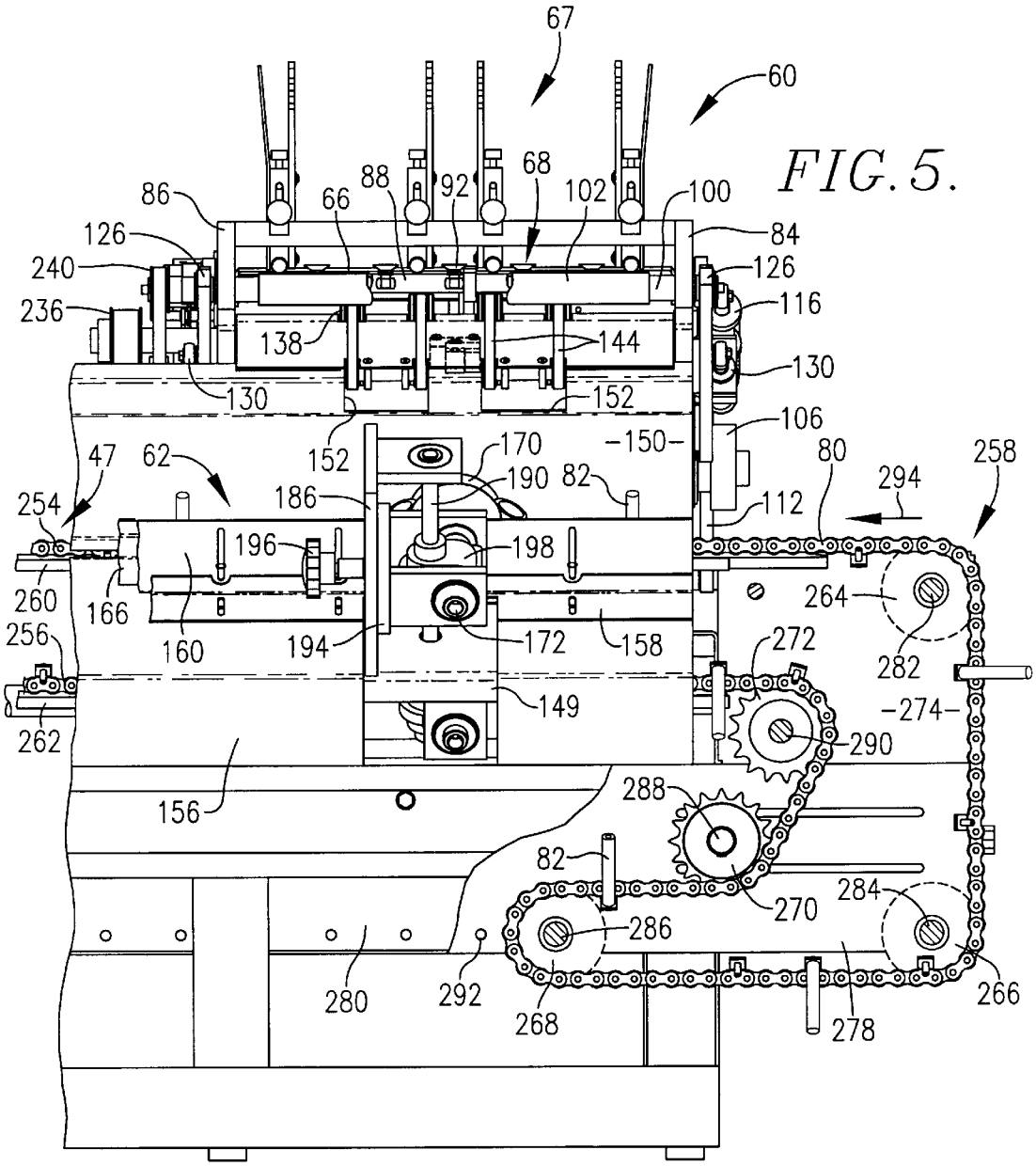
FIG. 5 is a fragmentary front view depicting the initial product infeed station forming a part of the machine.

The pusher pin chain assembly 78 includes an the elongated, continuous roller chain 80 which extends substantially the full length of machine 40 from station 42 to diverter 54; the frames of the machine stations have appropriately sized apertures therein to permit passage of the chain 80, such as openings 253 provided in side frames 146, 148. The chain 80 presents an upper run 254, a lower run 256, and a transition section 258. Each of the runs 254, 256 are supported on continuous elongated chain rails 260, 262 which extend the full length of the runs. The chain is trained around a forward sprocket 263 at the output end of machine 40 (FIG. 3) and the sprockets of the transition section 258. The transition section 258 includes a total of five idler sprockets 264, 266, 268, 270, 272 supported on a pair of upper side frame extensions 274, 276 and a pair of lower panels 278, 280 provided with the initial infeed station 42. Referring to FIGS. 5 and 6, it will be observed that the sprockets 264–272 are mounted on cross shafts 282, 284, 286, 288, 290 extending between the extensions 276, 276 and panels 278, 280. The shaft 286 is movable between respective pairs of mounting openings 292 provided in the spaced lower panels 278, 280, so that the position of sprocket 268 may be correspondingly moved. The importance of this feature will be explained.

The chain 80 moves in the direction of arrow 294 of FIG. 5. During such movement, the pins 82 carried by the chain are in an upright orientation along the upper run 254. At the output end of machine 40 as the pins traverse sprocket 263, they turn and extend downwardly along the course of lower run 256. In the transition section the pins 82 are again reversed so that they again assume their operative upright positions.

Figure 27:
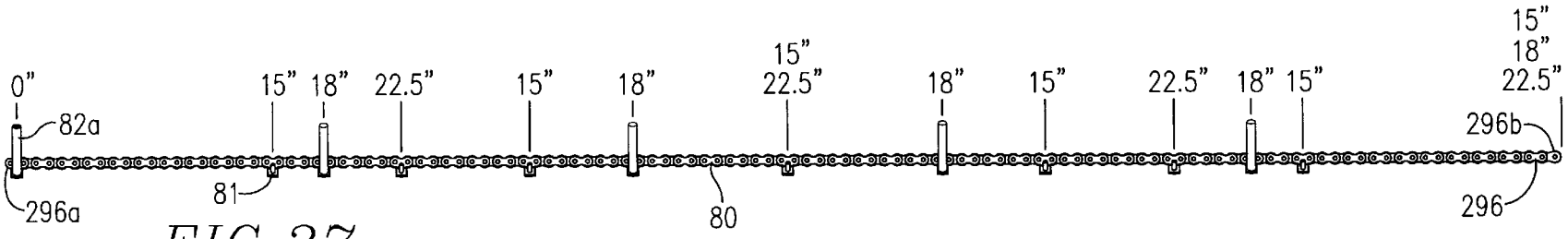
FIG. 27 is a side elevational view of a section of pin-supporting pusher pin chain, and showing the alternate position of pusher pins thereon for handling products of varying lengths.
Figure 31:
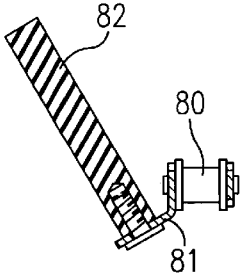
FIG. 31 is a vertical sectional view taken along line 31—31 of FIG. 30 and further showing the construction of the downstream pusher pins.
Figure 29:
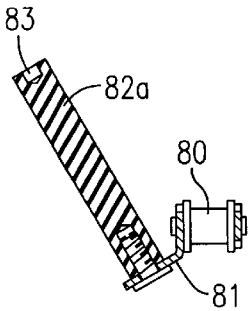
FIG. 29 is a vertical sectional view taken along line 29—29 of FIG. 28 and further showing the construction of the reference pusher pin.
Figure 30:
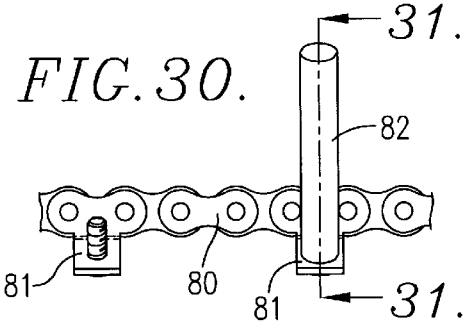
FIG. 30 is an enlarged, fragmentary side view illustrating the chain and pusher pin chain and one of the downstream pusher pins.
Figure 28:
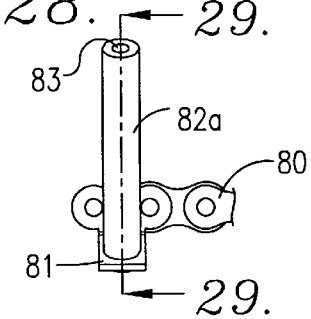
FIG. 28 is an enlarged, fragmentary side view illustrating the pusher pin chain and reference pusher pin.

The chain 80 is preferably divided into individual, interconnected chain sections 296. Each section 296 is of a length to be evenly divisible by a plurality of different lengths corresponding to the lengths of different types of products to be processed in machine 40. That is, a whole number of individual chain sections 296 are interconnected end-to-end to form the continuous chain 80, with each of the chain sections 296 including a plurality of pin mounts 81; the mounts 81 are arranged in a plurality of pin mount sets along the length of the chain section 296, with each of the mount sets having a number of pin mounts 81 evenly spaced along the length of the chain section 296 beginning at the first link 296*a* thereof and terminating at the last link 296*b* thereof. The distance between adjacent pin mounts 81 in each pin mount set is different than the spacing between adjacent pins in the other pin mount sets. By way of example, a 90" chain section is evenly divisible into increments of 15", 18" or 22.5". This means that pin mounts can be provided every 15" along the length of each section 296, and also every 18" and 22.5" along the length thereof. Accordingly, in this example the section 296 has three pin mount sets, namely a set wherein the pin mounts are 15" apart, a set where the pin mounts are 18" apart and a set where the pin mounts are 22.5" apart. Thus, when a product suitable for a 15" pin spacing is to be processed, pins 82 are installed on the pin mounts of the 15" pin mount set. However, when a larger product is to be processed, the chain 80 may be modified by mounting the pins 82 on the 18" or 22.5" pin mounts of those respective pin mount sets. As illustrated in FIG. 27, each section 296 includes a reference or key pin 82*a* at the zero position (i.e., link 296*a*) of the section which is preferably marked by an upper indicia 83 thereon, which may be a spot of paint or other visually perceptible marking. As will be readily appreciated, when a second section 296 is connected, the starting link 296*a* thereof is coupled with the end link 296*b* of the adjacent section.

Figure 2:
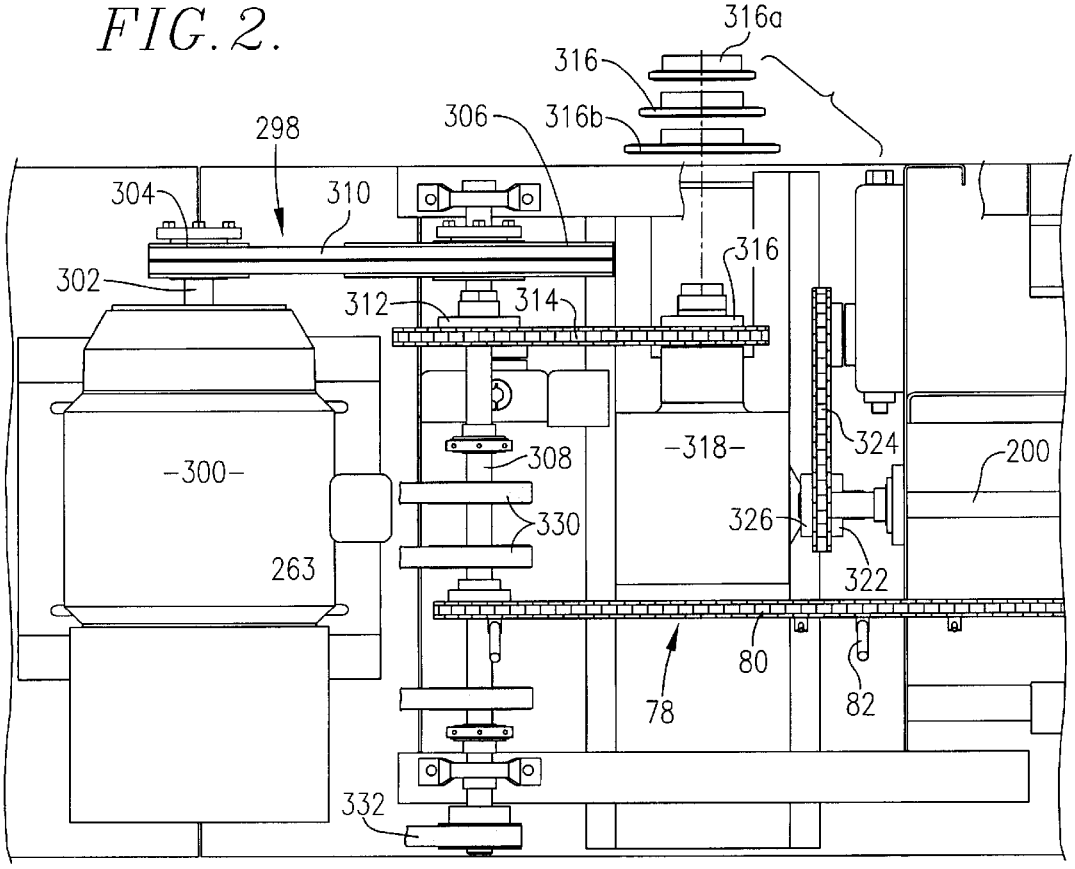
FIG. 2 is a fragmentary top view illustrating the main drive assembly for the machine.
Figure 3:
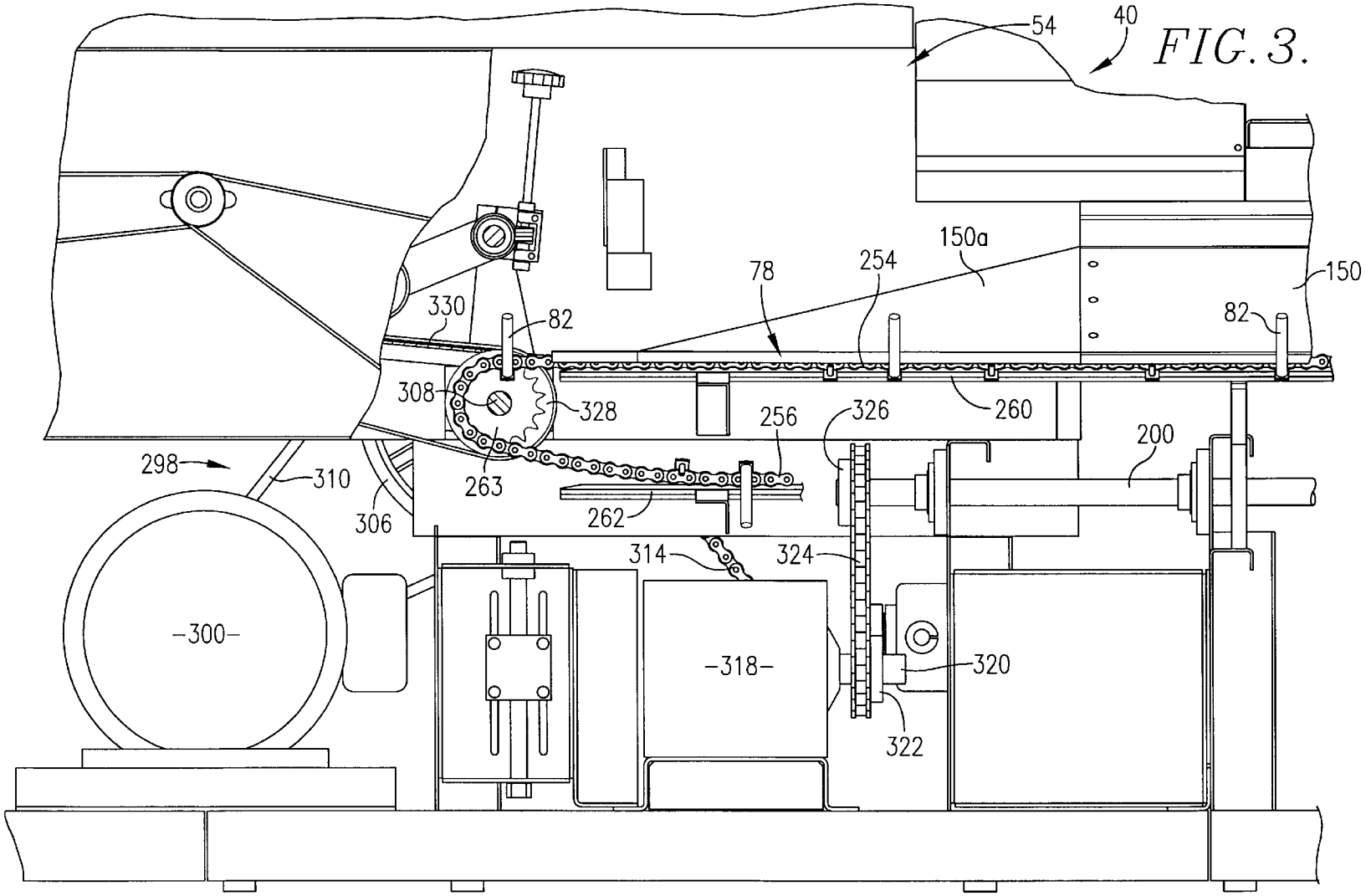
FIG. 3 is a fragmentary side view with parts broken away which further illustrates the main drive assembly.
Figure 4:
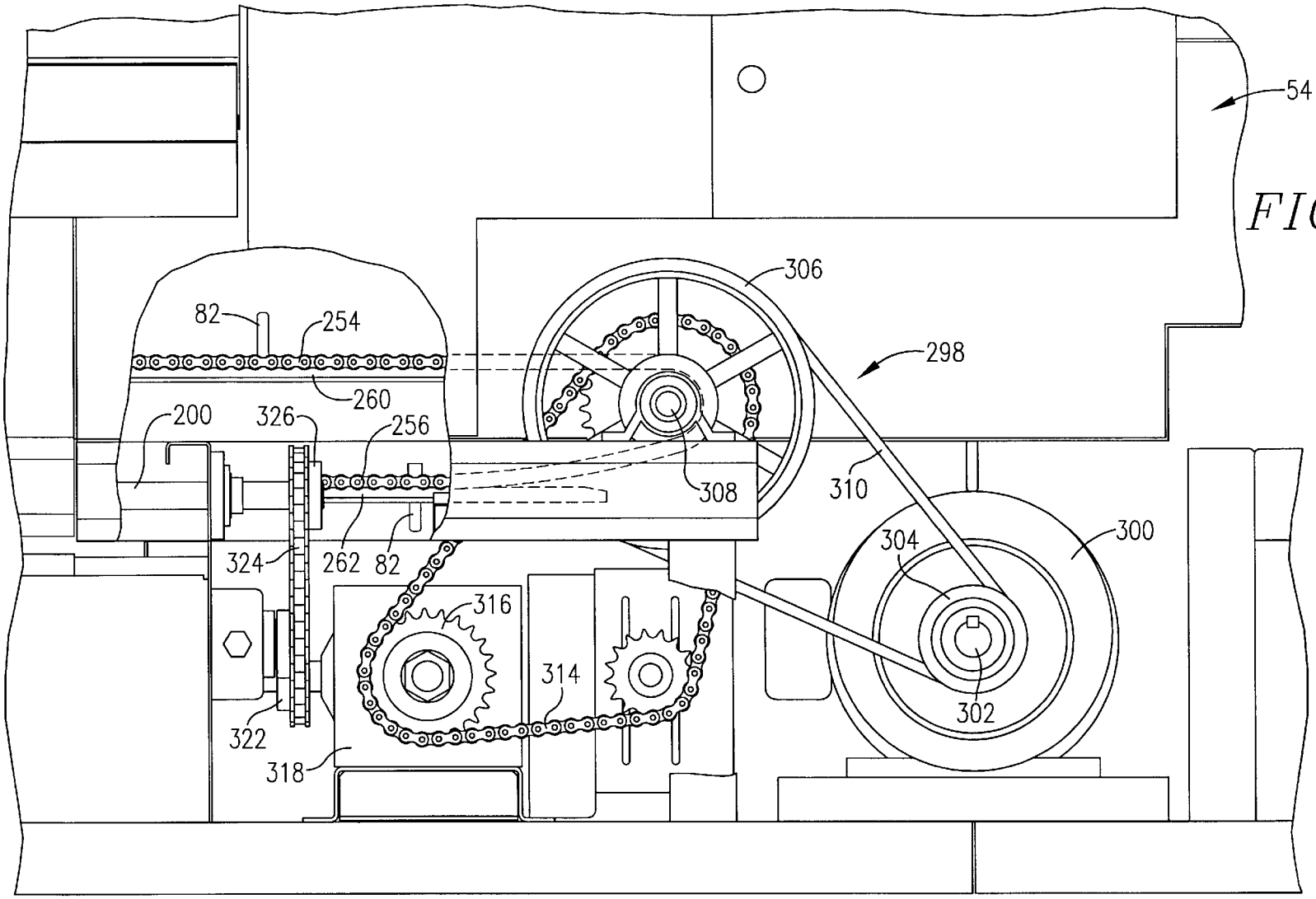
FIG. 4 is a fragmentary side view depicting the side of the main drive assembly opposite that illustrated in FIG. 3.

The main drive assembly 298 for the machine 40 is located near the output end thereof approximate to diverter gate 54. The assembly 298 includes a variable speed motor 300 having an output shaft 302 supporting a pulley 304. In addition, a large sheave 306 is mounted above motor 300 and is coupled with main drive shaft 308. A drive belt 310 is trained around pulley 304 and sheave 306 in order to rotate shaft 308. As best seen in FIG. 3, the sprocket 263 for chain 80 is affixed to drive shaft 308 in order to drive chain 80. A transfer sprocket 312 is also fixed to shaft 308 and has a drive chain 314 trained therearound. The drive chain 314 is further trained around a sprocket 316 forming a part of gear box 318. The latter has an output shaft 320 supporting a sprocket 322. Another drive chain 324 is trained around sprocket 322 and sprocket 326, the sprocket 326 being secured to line shaft 200. It will thus be seen that operation of motor 300 serves to not only drive the chain 80 but also provide torque for rotation of line shaft 200. As shown in FIG. 2, the sprocket 316 may be replaced with different diameter sprockets 316*a* or 316*b* to correspond with different desired machine operating speeds. These alternate sprockets are used during machine changeovers for handling of different sized products.

Referring to FIGS. 2 and 3, it will also be observed that the shaft 308 supports a series of pulleys 328 for driving of product-conveying belts 330 and drive belt 332. These latter components form a part of diverter 54 which form no part of the present invention. However, the preferred diverter is fully described in pending application for U.S. patent Ser. No. 09/069,258, filed Apr. 29, 1998 and entitled BIFURCATED DIVERSION GATE STRUCTURE FOR HIGH SPEED INSERTER. Additionally, details relating to the secondary infeed stations, and especially the opening wheels forming a part thereof, can be found in Pending Application U.S. patent Ser. No. 09/069,578, filed Apr. 29, 1998 and entitled OPENING WHEEL FOR HIGH SPEED INSERTER. All of the aforementioned patent applications are incorporated by reference herein.

OPERATION

Figure 17:
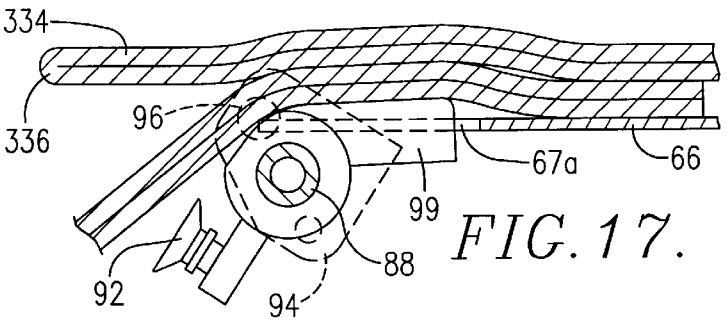
FIG. 17 is an enlarged sectional schematic view similar to that of FIG. 15 and taken along line 17—17 of FIG. 16 which further depicts the removal of product from the product table of the feeder and receiving station.
Figure 16:
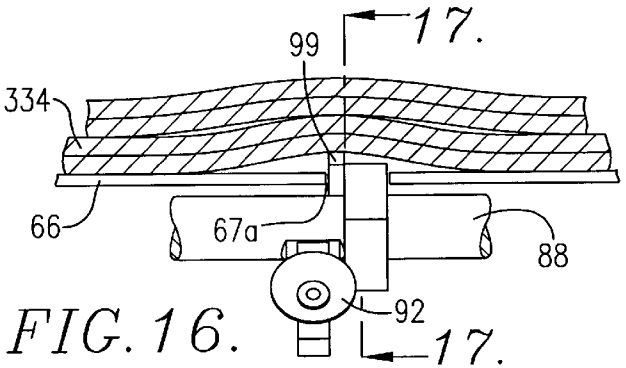
FIG. 16 is an enlarged, front schematic view illustrating the operation of the sucker bar assembly and the tenting finger.

In describing the operation of machine 40, it is assumed that the machine is configured for efficient running of products 334 (FIGS. 15–17) using an 18" spacing between the pusher pins 82, i.e., those pin mounts 81 on the respective chain sections 296 corresponding to 18" spacings are equipped with pins, the drive sprocket 316 is mounted on gear box 318, and the appropriately sized receiving wheel 170 is being used. Moreover, the feeder and receiving assemblies 60, 62 and diverter 54 are properly adjusted for the height of the products 334.

Attention is first directed to the operation of the feeder receiving assemblies 60, 62. Inasmuch as the operation of all such stations is identical, only one such unit is described. A stack of the products 334 is positioned on table 66 with the leading ends 336 of the products projecting forwardly beyond the upper terminal edge 66*a* of the table. The goal is to individually and successively remove the lowermost products 334 from the stack thereof, without disturbing the other product in the stack or creating a "bagging" problem. To this end, during operation of the sucker bar unit 68, the outboard cam 106 is rotated on shaft 110 which in turn causes pivoting of the blocks 94 about the axes of pins 96. This is accomplished through the medium of follower 114, arm 112 and link 116 coupled to block 94 adjacent side frame 84. Such movement (see FIGS. 15–17) causes the suckers 92 to first come into engagement with the leading edge 336 of the bottom most product 334 in order to grip the leading edge, whereupon the sucker bar 88 is pivoted downwardly which thus causes the lowermost product leading edge 336 to likewise pivot downwardly. However, owing to the location of the pins 96 so that the pivot axes for the block 94 and the product 334 are closely adjacent the edge 66*a*, this downward pivoting movement is accomplished without any substantial translation of the lowermost product 334 relative to the remainder of the stack. In order to further facilitate such pivoting and ultimate transfer of the lowermost product from the stack, the tenting finger 99*a* is moved upwardly (see FIGS. 16 and 17) though the table opening 67*a* in order to create a slight elevation or tenting of the lowermost product 334. This rigidifies the product to a certain extent, and greatly facilitates removal of this product from the stack.

The rotation of shaft 110 and cam 106 also causes simultaneous rotation of the internal cam 108 controlling operation of the nip roller unit 70. Thus, the translatory movement of the nip roller 100 is effected through rotation of cam 108 engaged by arm 120 and follower 122. As the cam rotates, the arm 120 moves and eventually engages the underside of bridge plate 134 attached to the third arms 132 fixedly secured to shaft 134. Such movement in turn moves the upright second arms 126 likewise fixed to the shaft 124 so that movement is imparted to the hollow nip roller 100. Of course, the operation of nip roller 100 is timed relative to the operation of the sucker shaft 88 so that the nip roller engages the leading edge 336 of the lowermost product 334 where the latter is fully pivoted downwardly and is in close adjacency with the upper runs of the oblique moving feeder belts 144. At the point where the nip roller 100 engages the leading edge of the product, the nip roller and feeder belts 144 cooperatively shift the lowermost product through the nip created between the roller 100 and the feeder belts 144 so as to deliver the product towards the receiving assembly 62. Of course, the nip roller 100 is continuously rotated through the previously described drive belt assembly 208, and specifically by means of second belt 246, whereas the belts 144 are moved by shaft 136 rotated by first belt 244.

Figure 18:
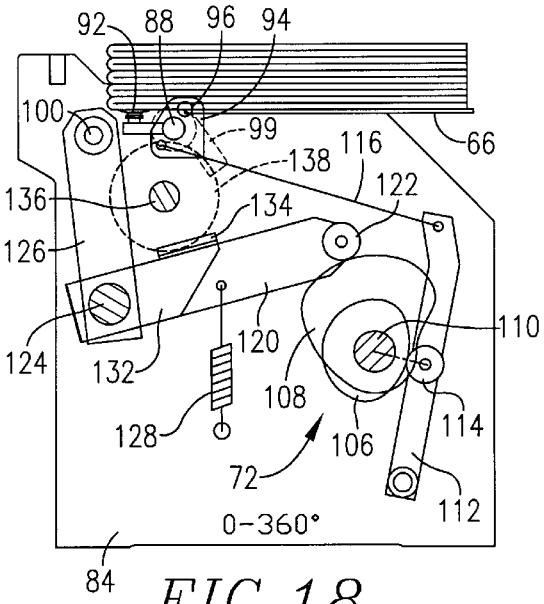
FIG. 18 is a schematic side view illustrating the operation of the sucker bar and nip roll assemblies at the initial stage of product removal.
Figure 19:
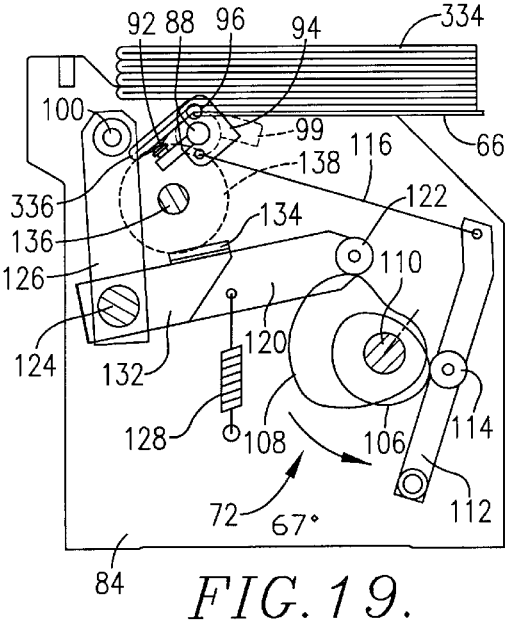
FIG. 19 is a view similar to that of FIG. 18, but depicting the first stage of product removal when the leading edge of the product is about to be gripped but before translational movement of the product.
Figure 20:
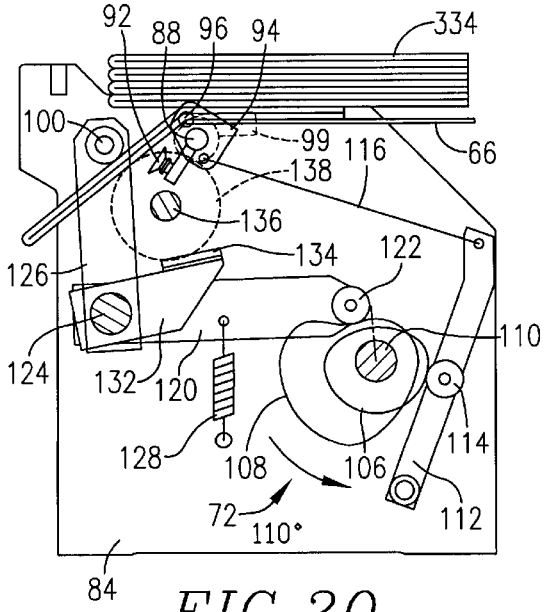
FIG. 20 is a view similar to that of FIG. 19 and illustrating the next stage of product removal where the product is gripped and is being translationally moved from the product table.
Figure 21:
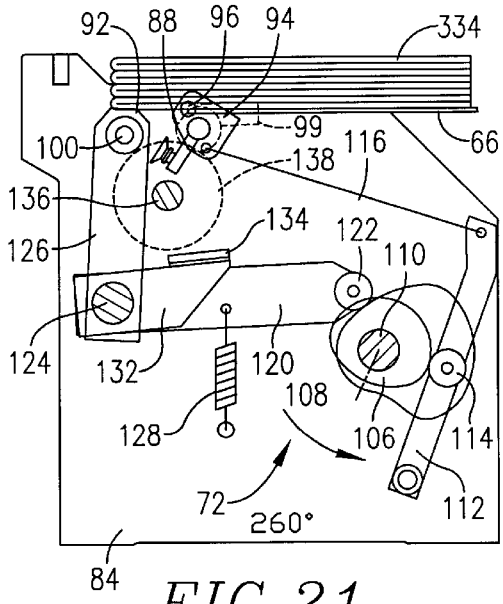
FIG. 21 is a view similar to that of FIG. 20 and illustrating the sucker bar and nip roller assemblies after the product has been delivered to the receiving assembly.

The timed operation of the sucker bar unit 66 and nip roller unit 70 can best be understood through a consideration of schematic FIGS. 18–21. In FIG. 18, the sucker shaft 88 is in its uppermost or zero position just prior to application of vacuum through the suckers 92. At approximately 0.67° during rotation of the shaft 110, a vacuum is pulled through the suckers 92 and shaft 88 in order to grip the leading edge of the lowermost product 334. FIG. 19 illustrates continued rotation of the sucker shaft 88 at a point of 67° during rotation of the shaft 110. It is at this point that the nip roller 100 comes into contact with the downwardly pivoted leading edge 336 of the product 334 and begins translation of the product for delivery to the receiving assembly 62, and the vacuum through sucker 92 is relieved. FIG. 20 illustrates the location of the sucker shaft 88 and nip roller 100 at the 110° rotational position of shaft 110, which is midway during product delivery. Finally, FIG. 21 depicts these components at the 260° rotational position of the shaft 110, where the lowermost product 334 has been delivered towards receiving assembly 62. During the remainder of the rotation of the shaft 110, the sucker shaft 88 and nip roller 100 are moved back to their starting or zero position illustrated in FIG. 18.

It has been found that the use of a hollow nip roller 100 gives significant operational advantages, as compared with conventional solid nip rollers. That is, the lighter weight of the hollow roller 100 reduces the characteristic "bounce" encountered during high speed feeding operations, thus increasing the feeding speed.

Figure 24:
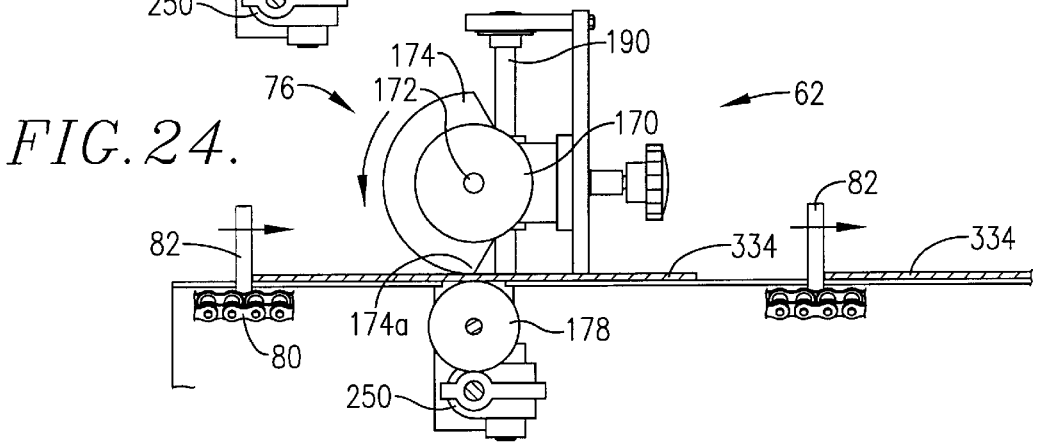
FIG. 24 is a schematic view similar to that of FIG. 23, and illustrating the receiving assembly when the pusher in and receiving wheel first engage the product.

After a product 334 has been gripped and fed by the feeder assembly 60, it is delivered to receiving assembly 62. This involves dropping of the product 334 onto the oblique support plate 150 which in turn causes the leading edge 336 of the product to pass downwardly into receiver structure 74 and bottom out against plate 160 between the plates 164, 166. Preferably, the operation of the receiving assembly 62 is such that the leading edge 174*a* (FIGS. 23–26.) of the resilient element 174 engages the product 334 at substantially the same instant that an upright pusher pin 82 engages the lefthand edge thereof as best seen in FIG. 24. As explained previously, the rotation of wheel 170 is effected through the medium of drive chain 222, gear box 206, shaft 248, gear box 250, shaft 190 and gear box 198, all driven by the primary gear box 204 coupled to line shaft 200. Likewise, the chain 80 is continuously driven by means of main drive shaft 208 and sprocket 263 coupled to main drive motor 300.

Figure 25:
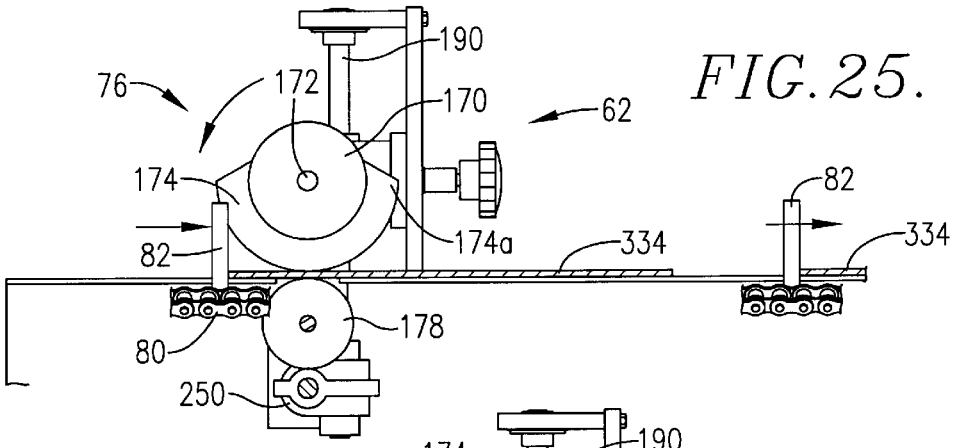
FIG. 25 is a schematic view similar to that of FIG. 24, and showing the product being moved from the receiving assembly by the combined action of the pusher pin and receiving wheel.
Figure 26:
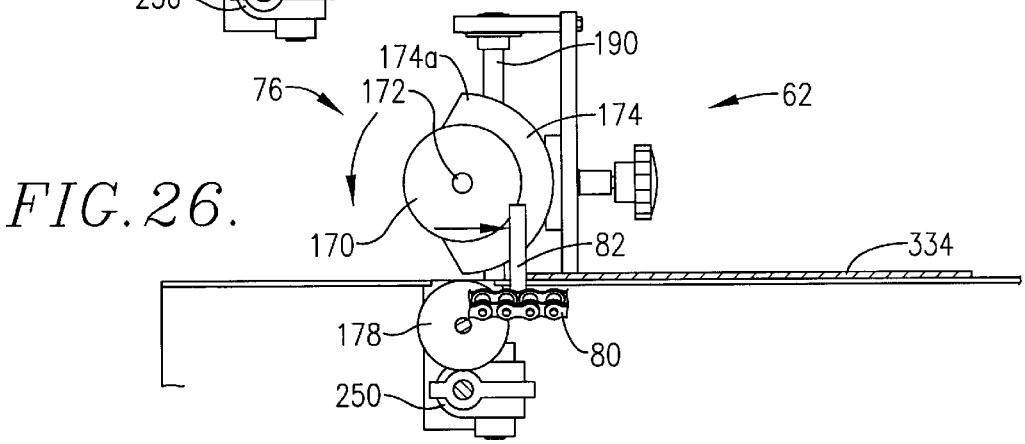
FIG. 26 is a view similar to that of FIG. 25 and showing the product moving from the receiving assembly by engagement of the pusher pin, and after the product has cleared the receiving wheel.

Once the resilient element 174 and adjacent pusher pin 82 contact the product 334, it is immediately moved rightwardly as viewed in FIGS. 24–26 between the driven resilient element 174 and lower idler 178 until the product fully clears the wheel unit 76. Thereupon, the product 334 is moved solely under the influence of the adjacent pin 82 through the remainder of machine 40 until the product is shifted into diverter 54. During such movement, the aforementioned secondary infeed stations 48, 50 and/or 52 are used to insert advertising circulars or other materials into the products 334. As explained above, the details of construction and operation of the preferred diverter 54 and secondary infeed stations are described in the incorporated by reference patent applications.

After a given run of product through the machine 40, it may be necessary to reconfigure the machine to handle differently sized products. When this occurs, it is a simple matter to change over the machine 40 to accommodate such different products. To give but one example, if products are to be processed which require a 15" spacing between the pins 82, the continuous chain 80 is modified by installing pins 82 on the 15" mounts 81 (FIG. 27) of each chain section 296, and removing those from the 18" mounts. Second, the sprocket 316 is replaced by sprocket 316*a* so as to appropriately change overall machine speed. Also, wheel 170 is replaced by a different diameter wheel which correlates with the other changeover modifications made to the machine. When these changes are made and other minor timing modifications are completed, and the new wheel is adjusted vertically through use of adjusting unit 184, the machine 40 can be used to process the smaller products. Of course, the same procedure would be followed for larger products, such as those requiring a 22.5" pin spacing.

If it is desired to add or delete stations from the machine 40, it may be necessary to change the overall length of chain 82. In keeping with the present invention, the chain 82 will contain a whole number of the interconnected sections 296. In order to maintain this relationship, the transition section 258 is modified by moving sprocket-supporting cross-shaft 286 to another of the openings 292 provided for this purpose. Thus, a set of openings 292 is selected which will create the desired lengths for the upper and lower chain runs 254–256, while maintaining the use of a whole number of chain sections 296.

Each of the feeder assemblies 60 is also equipped with a sensor 145*a* positioned as shown in FIG. 8. In the event of a misfeed at one of the feeder assemblies, a signal is sent through the machine control circuitry to the diverter 54 so that, at the appropriate time, the diverter 54 operates to divert the misfed product away from the acceptable product stream.

We claim:

1. Apparatus for diverting a stream of multi-page, relatively flat products such as newspapers from a first path of travel to a second path essentially perpendicular to the first path and in predetermined, sequenced relationship, said apparatus being capable of handling products that vary in thickness from time to time and comprising:

a product receiving assembly in disposition to receive successive products directed thereto along said first path and provided with an inclined product support surface for directing each product to a path direction diversion area, said support surface having a stop for arresting the movement of a product on said surface that is moving along said first path;

a drive wheel at said diversion area of the support surface, said wheel being coupled to an output shaft rotatable about an axis parallel to said first path and perpendicular to the second path and provided with a resilient, segmental, peripheral product engaging element extending around only a portion of the periphery of the wheel;

a rotatable anvil adjacent the drive wheel, mounted for rotation about an axis parallel to the axis of rotation of the drive wheel and spaced therefrom a distance for cooperating with the segmental element to receive a product therebetween and move each of the products along said second path, said element being of a circumferential length and oriented in disposition around the periphery of the wheel such that during rotation of the wheel the element does not come into driving engagement with a respective product to move the product along said second path until at least about the time that movement of a product along said first path is arrested by said stop;

a drive unit connected to the shaft of the wheel for rotating the wheel, said drive unit being mounted for selective shifting movement toward and away from the support surface to vary the distance between the element on the wheel and the anvil to allow adjustment of the wheel to accommodate products of different thicknesses; and a feeder unit at said diversion area for feeding a product whose movement has been arrested by the stop, toward and into a location to be moved along said second path by the wheel element during rotation of the wheel.

2. The apparatus as set forth in claim 1, wherein said feeder unit includes a shiftable upright pin for engaging the trailing edge of said product in order to push said product in said second direction.

3. The apparatus as set forth in claim 1, wherein said drive unit includes an upright drive shaft, and a gear box operably coupled to the drive shaft, said gearbox being connected to said output shaft for rotating the drive wheel, the gear box being mounted for selective shiftable movement along the length of the drive shaft to permit adjustment of the spacing of the drive wheel relative to said anvil.

* * * * *